United States Patent [19]

Kobayashi et al.

[11] Patent Number: 4,903,598

[45] Date of Patent: Feb. 27, 1990

[54] PRINTING PAPER SUPPORTING DEVICE OF A PRINTER

[75] Inventors: Yousuke Kobayashi; Toshiaki Tohi, both of Fukuyama, Japan

[73] Assignee: Mitsubishi Denki Kabushiki Kaisha, Tokyo, Japan

[21] Appl. No.: 338,083

[22] Filed: Apr. 14, 1989

[30] Foreign Application Priority Data

May 2, 1988 [JP] Japan ..... 63-107604

[51] Int. Cl.[4] ..... B41F 21/04

[52] U.S. Cl. ..... 101/409; 101/415.1

[58] Field of Search ..... 101/409, 410, 411, 415.1; 242/74, 74.1

[56] References Cited

U.S. PATENT DOCUMENTS 4,536,772 8/1985 Isogai .

4,627,754 12/1986 Sholtis et al. ..... 400/649

*Primary Examiner*—Edgar S. Burr

*Assistant Examiner*—Joseph R. Keating

*Attorney, Agent, or Firm*—Sughrue, Mion, Zinn, Macpeak & Seas

[57] ABSTRACT

A paper clamping mechanism for clamping a sheet of printing paper on a drum-shaped platen of a printer is disclosed. The mechanism comprises a clamp member radially slidably mounted at its legs to the end surfaces of the platen, and a lever pivotted to the frame of the printer. The clamp member comprises a pressor which opposes an axial recess on the peripheral surface of the platen; the front end portion of a sheet of paper is held between the pressor and the recess during the printing operation, the clamp member being urged toward the axis of the platen by a spring. The clamp member further comprises an axially extending pin formed on a leg thereof. The lever is urged by a spring to a position at which it is stopped by a pin formed on the frame of the printer. An arm of the lever comes into contact with the pin on the leg of the clamp member when the clamp member is rotated with the platen. When the arm of the lever comes into contact with the pin on the clamp member rotated in the printing direction, the lever turns and yields upon contact; when, on the other hand, the arm comes into contact with the pin on the clamp member rotated in the reverse direction, the pin slides on the arm of the lever which is stopped by the stopper pin, so that the clamp member is raised from the platen to form a gap between the pressor and the recess on the platen.

5 Claims, 4 Drawing Sheets

PRINTING PAPER SUPPORTING DEVICE OF A PRINTER

BACKGROUND OF THE INVENTION

This invention relates to printers such as those effecting printing by the thermal transfer of dye materials, and more particularly to an improvement of the paper gripping or clamping mechanism in a printing paper supporting device of printers which includes a drum-shaped platen.

Recently, thermal transfer type printers have come into wide use, in which a thermal head is pressed against a sheet of printing paper supported on a cylindrical platen to transfer a dye material carried on an ink sheet or ribbon to the sheet of paper. Some of these thermal transfer type printers are capable of printing full color images; in such case, a sheet of printing paper must undergo several printing operations in each of which a different primary color is printed thereon so that several primary colors are superposed on each other to produce a full color image. In the case of these full color printers, it is very important that the sheet of paper under printing operations is securely held in position on the platen during printing of several colors so that color dislocations may be minimized. Thus, they usually comprise a paper clamping mechanism for holding the sheet paper securely on the platen drum during printing operations.

A typical paper supporting device of a thermal transfer printer which includes a platen drum for backing up a sheet of printing paper, and a mechanism for clamping it thereon during the printing operation is shown in FIGS. 1 and 2; FIG. 1 shows the state of the device during paper feeding, while FIG. 2 shows it during a printing operation. The printer shown in these figures comprises a thermal head 1, and a take-up roll 2*a* and a feeding roll 2*b* for taking up and feeding the ink sheet or ribbon 3 carrying a thermally transferable dye material thereon; the ink sheet 3 is fed from the feeding roll 2*b* in the direction A to be wound up by the take-up roll 2*a*. Each sheet of printing paper 6 is guided on a paper guide 5.

The platen drum 4, which rotates in the printing direction shown by the arrow B in FIG. 1, has a recess 4*a* formed on its peripheral surface. A paper clamper 8, pivoted to the side surfaces of the platen 4, is urged by helical springs 7 toward the main surface of the recess 4*a* to hold the front end portion of a sheet of printing paper 6 therebetween which is supplied on the guide 5.

On the other hand, a lever 12 is pivotably mounted on the frame of the printing paper. A solenoid 11, when energized, turns the lever 12 in the clockwise direction as viewed in the figure; as a result, the end of the lever 12 abuts and bears against the pin 9 formed on the clamper 8, and lifts the clamper 8 against the urging action of the spring 7, thereby forming a gap between the clamper 8 and the recess 4*a* on the platen 4. By the way, reference numeral 10 designates a pinch roller 10 rotatably mounted to the frame of the printer to press down the printing paper 6 wrapped around the platen drum 4.

The operation of the device shown in FIGS. 1 and 2 may now be easily understood: When the front end portion of a sheet of printing paper 6 is received between the recess 4*a* and the clamper 8 which is lifted by means of the energized solenoid 11, the solenoid 11 is de-energized to lower the lever 12. Thus, the clamper 8 is urged down by the spring 7 and the front end portion of the sheet of printing paper 6 is held between the recess 4*a* and the clamper 8. When the front end portion of the sheet of printing paper 6 is thus held between the recess 4*a* and the clamper 8, the platen 4 rotates in the direction B, to wrap the paper 6 therearound, so that the tail-end portion of the sheet of paper 6 is pressed down by the pinch roller 10. When the printing paper 6 is thus wrapped around the platen 4, the thermal head 1 is lifted to bear against the platen 4 as shown in FIG. 2, and starts to print images, such as characters and figures, on the sheet of paper 6 by selectively transferring the dye material carried on the ink sheet 3 to the sheet of paper 6.

The above described device, however, suffers from the following disadvantages. Namely, the structure of the clamping device makes it necessary to dispose the solenoid 11 near the pivot of the lever 12. Thus, a large solenoid is needed to overcome the urging action of the spring 7, which, on the other hand, must have a sufficient strength to hold the paper securely between the clamper 8 and the recess 4*a* during a printing operation; consequently, the printer becomes large-sized and expensive. Further, a large solenoid generates a loud operation noise, which gives rise to an additional problem of the conventional device.

SUMMARY OF THE INVENTION

It is a primary object of this invention therefore to provide a paper supporting device of a printer including a drum-shaped platen which is capable of clamping a sheet of printing paper securely in position on the platen during printing operations without utilizing a solenoid; in particular, this invention aims at providing such paper supporting device which is suitable for use with thermal transfer type printers which are capable of printing full color images.

It is an additional object of this invention to provide such a paper supporting device which is capable of securely clamping a sheet of printing paper by means of a simple and inexpensive meachanism that is quiet in operation.

The above objects are accomplished in accordance with the principles of this invention in a paper supporting device of a printer which comprises a cylindrical platen, a clamping assembly, and a lever assembly. The platen, rotatably mounted to the frame of the printer, has a recess formed on the peripheral surface of the platen, which recess extends in the axial direction of the platen. The clamping assembly, which is mounted to the platen to be rotated therewith, includes a clamp member slidable in a radial direction but constrained in the circumferential direction with respect to the platen, and a urging means, such as a helical spring, for urging the clamp member in the radial direction toward the axis of the platen. The clamp member comprises a pressor portion which extends in the axial direction of the platen to oppose a surface of the recess on the platen. Thus, the pressor portion of the clamp member may either be pressed on or raised from the recess on the platen, depending on the radial position of the clamp member. The clamp member further comprises an axial projection or pin extending from an axial end portion thereof in a direction away from the platen.

The lever assembly, which is provided to effect the radial movement of the clamp member, includes a lever pivotably mounted to the frame, a stopper for limiting the turning of the lever in a first pivoting direction, and an urging means for urging the lever in the first direction to the position at which the lever is stopped by the stopper. The lever comprises an arm which comes into contact with the axial projection on the clamp member.

When the arm of the lever comes into contact with the projection on the clamp member rotated in the forward or printing direction with the platen, the lever is turned in a second direction opposite to the first direction against an urging action of the urging means, to give way to a rotational motion of said projection on the clamp member around the axis of the platen; thus, during the time in which a sheet of printing paper is being wrapped around the platen or a printing operation is effected on the sheet of paper which has been thus wrapped on the platen, the platen is allowed to continue its forward rotation without being hindered by the contact of the axial projection on the clamp member with the arm of the lever, with the presser portion of said clamp member being pressed on the opposing surface of the recess on the platen. Thus, during the paper setting or printing operation, the sheet of paper on the platen is securely held between the pressor of the clamp member and the recess on the platen.

On the other hand, when the arm of the lever comes into contact with the projection on the clamp member rotated in the reverse direction with the platen, the projection on the clamp member is forced to slide along the arm of the lever which is stopped by the stopper and thus cannot turn further in the first direction. In the position in which the lever is stopped by the stopper, the direction of the arm (from its end to its base or pivoting portion) is roughly in agreement with the reverse rotational direction of the projection on the clamp member around the axis of the platen; however, the arm of the lever is slanted with respect to the rotational direction of the projection on the clamp member around the axis of the platen, in such a manner that the end of the arm is nearer to the axis of the platen than the base or pivoting portion thereof. Thus, when the projection comes into contact with the arm of the lever, the clamp member is slided with respect to the platen in the radial direction away from the axis of the platen against an urging action of the urging means, with the reverse rotation of the platen, thereby forming a gap between the pressor portion of the clamp member and the opposing surface of the recess on the platen.

When a sheet of printing paper is to be set on the platen, the front end portion of the printing paper is inserted into the gap formed between the pressor portion of the clamp member and the recess on the platen; and the platen is again rotated in the forward direction so that the the projection on the clamp member slides on the arm of the lever toward its end to be finally disengaged therefrom. Thus, the clamp member is slided with respect to the platen in the radial direction toward the axis of the platen so that the pressor portion of the clamp member is pressed on the recess on the platen, the front end portion of the sheet of paper being securely held therebetween.

In a preferred embodiment, the clamp member comprises a pair of leg portions extending from end portions of its pressor portion in the radial direction of the platen along the end surfaces of the platen; in such case, each of the leg portions is mounted to an end surface of the platen to be slidable in the radial direction. For example, the leg portions of the clamp member may each have a groove extending in the radial direction of the platen, an axle of the platen slidably extending therethrough. Further, a disk-shaped cam member may each be fixedly secured to the platen between an end surface of the platen and a leg portion of the clamp member, the disk-shaped member having a notch extending from a circumference thereof in the radial direction toward its center; then, the leg portions of the clamp member may each have a pin formed on a surface thereof to be slidably fitted into the notch of the disk-shaped members.

According to this invention, the lever assembly consisting of a simple mechanism is capable of raising the pressor of the clamp member from the recess on the platen to form a gap therebetween when the paper is to be fed or discharged. This is effected automatically by rotating the platen in the reverse direction; the solenoid can be dispensed with. Thus, the operation noise is reduced; further, the device can be made smaller and more economical.

BRIEF DESCRIPTION OF THE DRAWINGS

The novel features which are believed to be characteristic of our invention are set fourth with particularity in the appended claims. Our invention itself, however, both as to its structure and method of operation, together with further objects and advantages thereof, may best be understood by referring to the following detailed description of the preferred embodiment, taken in conjunction with the accompanying drawings, in which:

In the drawings, like reference numerals represent like or corresponding parts or portions.

DETAILED DESCRIPTION OF THE PREFERRED EMBODIMENT

Figure 1:
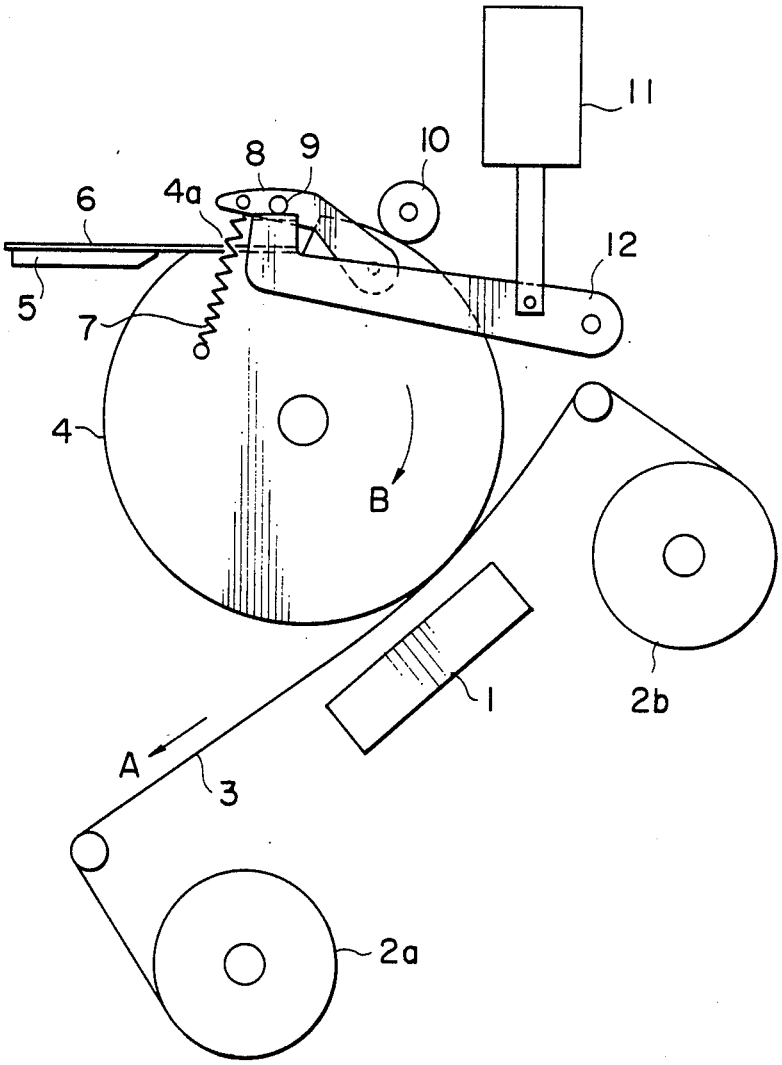
FIG. 1 PRIOR ART
FIG. 1 is a side elevational view of a conventional paper supporting device of a thermal transfer type printer including a drum-shaped platen, the view showing the device during paper feeding operation.
Figure 2:
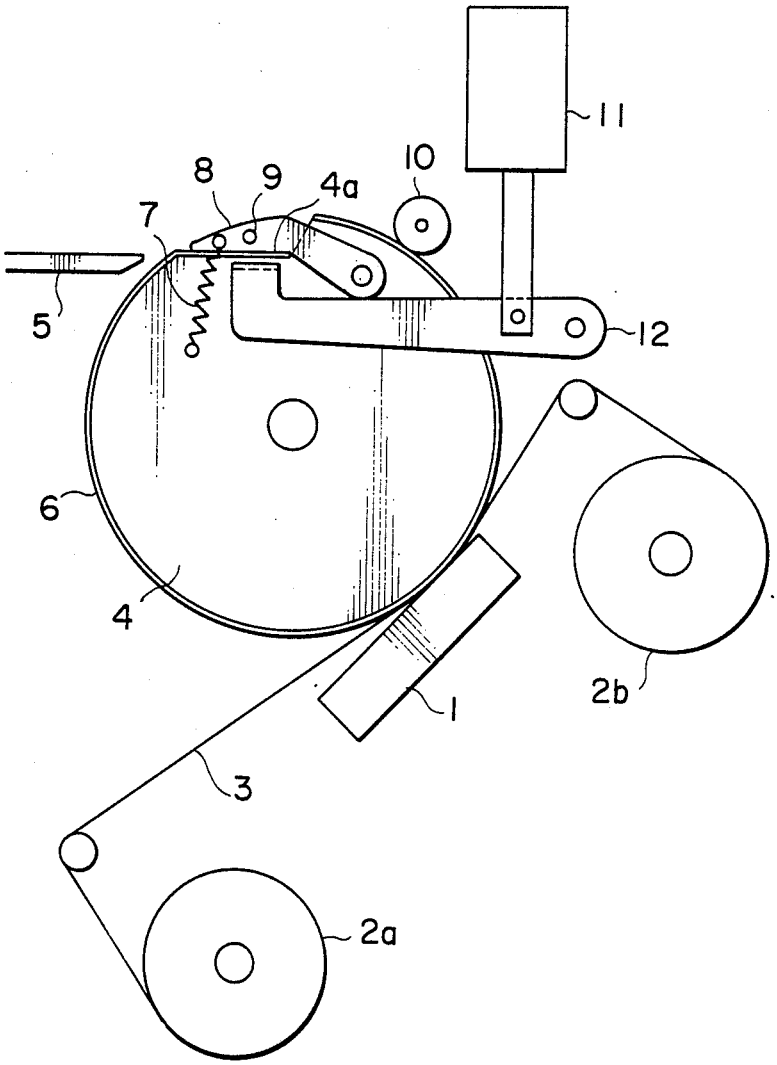
FIG. 2 PRIOR ART
FIG. 2 is a view similar to that of FIG. 1, but showing the device of FIG. 1 during the printing operation.
Figure 3:
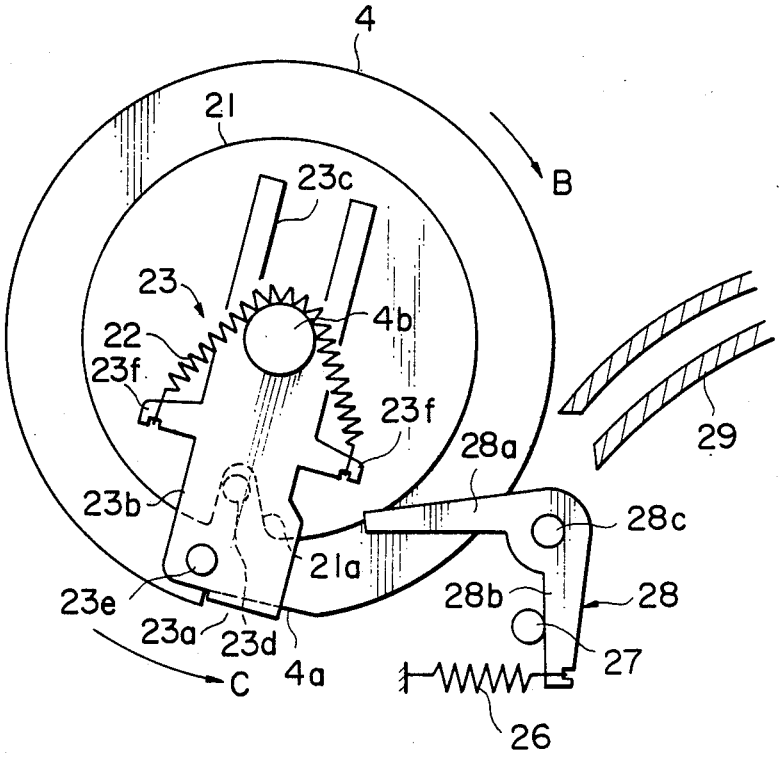
FIG. 3 is a view similar to that of FIG. 1, but showing a paper supporting device according to an embodiment of this invention, the view showing the device in the state in which the clamp member is pressed on the platen.
Figure 4:
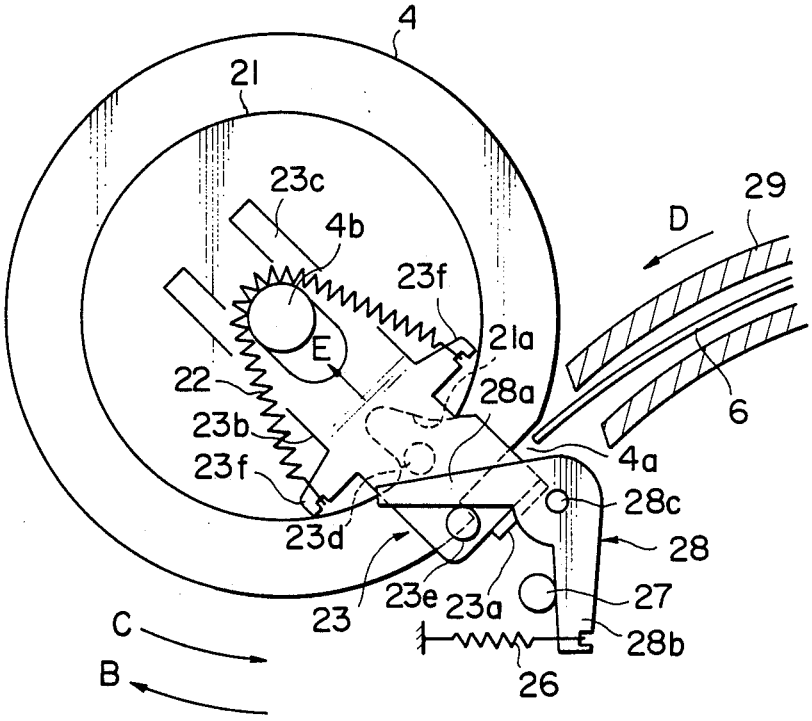
FIG. 4 is a view similar to that of FIG. 3, but showing the device of FIG. 3 in the state in which the clamp member is raised from the platen.

Referring now to FIGS. 3 and 4 of the drawings, a paper supporting device of a thermal transfer printer according to an embodiment of this invention is described. (In FIGS. 3 and 4, the thermal head, and the feeding and take-up rolls for feeding and winding up the ink sheet or ribbon carrying dye materials, shown in FIGS. 1 and 2, which form part of the printer, are omitted.)

A cylindrical or drum-shaped platen 4 for supporting a sheet of printing paper during the printing operation has a recess **4*a* formed on the peripheral surface thereof. The recess 4*a*, which is defined by a bottom or main surface substantially perpendicular to the radial direction of the platen 4 and a surface which is substantially perpendicular to the bottom surface, extends in the axial direction over the whole axial length of the platen 4. On each end surface of the platen 4 is secured a disk-shaped cam 21 of a diameter smaller than that of the platen drum 4; each disk-shaped cam 21 has a V-shaped groove or notch 21*a* extending in a radial direction from its circumference toward its center. The axle 4b of the platen 4 is journalled at its ends in bearings disposed in the frame (not shown) of the printer; thus, the platen 4** is supported by the frame of the printer in a manner rotatable around its axis.

A clamp member, generally designated by a reference numeral 23 and mounted to the platen drum 4 to be slidable in the radial direction, comprises a plate-shaped pressor portion 23a which extends in the axial direction of the platen 4 to oppose the main surface of the recess 4a over its whole length; as described below, during the printing operation, between the pressor portion 23a of the clamp member 23 and the opposing surface of the recess 4a is held a front end portion of a sheet of printing paper 6 supplied from the paper guide 29. The clamp member 23 further comprises a pair of plate-shaped legs 23b extending from the axial ends of the pressor portion 23a in the radial direction of the platen drum 4 along end surfaces of the platen 4 over the disk-shaped cams 21. Each leg 23b has a groove 23c extending from its radial end in the radial direction of the platen 4, in which grooves the axle 4b of the platen 4 slidably extends in the axial direction. Further, a pin 23d is formed ont he surface of each leg 23b which opposes the disk-shaped cam 21 (i.e. on the back surface of the leg 23b as viewed in the figures); the pin 23d projects therefrom in the axial direction toward the end surface of the platen drum 4 to slidably fit into the notch 21a of the disk-shaped cam 21. Thus, the clamp member 23 is mounted to the platen drum 4 in such a manner that it is capable of sliding in the radial direction with respect to the platen drum 4, but is constrained in the movement in the circumferential direction with respect thereto thanks to the engangement of the pins 23d on the legs 23 with the notches 21a in the cams 21 secured at both ends of the platen drum 4.

Further, the clamp member 23 is urged in the radial direction towrad the axis of the platen 4 by helical springs 22. Namely, a helical spring 22, which is secured at its ends to the wings 23f projecting from the sides of each leg 23b of the clamp member 23, is wound around the axle 4b to urge the clamp member 23 in the radial direction E (as shown in FIG. 4) toward the axis of the platen 4.

By the way, on the surface of a leg 23b directed away from the end surface of the platen 4 (i.e. on the front surface of the leg 23b as viewed in the figures) is formed another pin (or axial projection) 23e which extends therefrom in the axial direction away from the end surface of the platen 4. As described below, the pin 23e engages (or comes into contact) with an arm of a lever 28.

The lever assembly for lifting the clamp member 23 from the platen 4 in the clamping and discharging of a sheet of printing paper comprises following parts: a lever 28, pivoted on a pin or pivot 28c secured to the frame of the printer, which lever has a pair of arms 28a and 28b extending substantially at right angles; a stopper pin 27 secured to the frame of the printer to extend in the axial direction of the platen drum 4; and a helical spring 26 secured at its ends to the end of the arm 28b of the lever 28 and the frame of the printer (represented by a shaded fragment), respectively. The pivot 28c extends in a direction parallel to the axis of the platen 4, at an axial position substantially in alignement with the axial position of the pin 23e on the leg 23b of the clamp member 23. The stopper 27 abuts against the arm 28b of the lever 28 to limit the clockwise rotation of the lever 28 at a predetermined angle at which the opposite arm 28a is slightly slanted with respect the the circumferential direction of the platen 4, so that the end of the arm 28a is nearer to the axis of the platen 4 than its base portion of the pivot 28c, as shown FIGS. 3 and 4; on the other hand, the spring 26 urges the lever 28 in the clockwise direction (directions are as viewed in the figures). The arm 28a engages or comes into contact with the pin 23e when the clamp member 23 is rotated with the platen drum 4.

Namely, when the platen 4 rotates in the reverse direction C (which is counter-clockwise as viewed in the figures) opposite to the printing or forward direction B from the position shown in FIG. 3, the pin 23e on the leg 23b of the clamp member 23 comes into contact with the lower side of the arm 28a of the lever 28. Thus, the lever 28 receives a clockwise torque (as viewed in the figures) from the pin 23e bearing upon the lower side of the arm 28a. However, the clockwise rotation of the lever 28 is stopped (or limitted) by the stopper 27; thus, as the platen 4 rotates further in the reverse direction C, the pin 23e slides on the lower side of the arm 28a, thereby sliding the clamp member 23 in the radial direction away from the axis of the platen 4 with respect thereto, against the urging action of the spring 22 which is acting in the direction E. Thus, as shown in FIG. 4. the pressor portion 23a of the clamp member 23 is lifted from the opposing surface of the recess 4a on the peripheral surface of the platen 4, to form a gap therebetween.

When, on the other hand, the platen 4 rotates in the forward or printing direction B, the pin 23e comes into contact with the upper side of the arm 28a during the time in which the pin 23e passes in the neighborhood of the lever 28. Thus, upon such occasions, the lever 28 receives a counter-clockwise torque (as viewed in the figures) from the pin 23e bearing upon the upper side of the arm 28a thereof. The lever 28 is thus turned in the counter-clockwise dircection against the urging force of the spring 26 to give way to the rotation of the clamp member 23 that is rotated with the platen drum 4. Consequently, the platen 4 can continue to rotate in the forward direction B (as many number of turns as are desired) with the pressor portion 23a of the clamp member 23 tightly pressed against the recess 4a on the platen 4.

Now the operation of the device in the setting and discharging of a sheet of printing paper, or the operation during printing, may easily be understood.

The methd of operation of setting a sheet of paper around the palten 4 is as follows. The platen 4 is rotated in the reverse direction C to the position shown in FIG. 4 to form a gap between the pressor 23a and the recess 4a, as described above. When a sheet of paper 6 is fed in the direction D along the guide 29 to the position at which it is to be clamped, the platen drum 4 is rotated in the forward direction B in synchronization with the feeding movement of the sheet of paper 6. Thus, as the clamp member 23 rotates with the platen 4, the pin 23e on the leg 23b of the clamp member 23 slides on the lower side of the arm 28a of the lever 28 from the position shown in FIG. 4 toward the end of the arm 28a (toward right in the figure), so that the clamp member 23 slides, with respect to the plate 4, in the radial direction E toward the axis of the platen 4, being urged by the spring 22. Thus, the gap between the pressor 23a and the recess 4a is gradually narrowed with the forward rotation of the platen 4. In the mean time, the front end portion of the sheet of paper 6 is forwarded into the gap between the pressor 23*a* and the recess 4*a*. As a result when the pin 23*e* comes out of engagement with the arm 28*a* of the lever 28 and the pressor 23*a* bears against the opposing surface of the recess 4*a*, the front end portion of the sheet of paper 6 is securely held between the pressor 23*a* and the opposing surface of the recess 4*a*. Thereafter, the platen drum 4 continues to rotate in the forward direction B, thereby wrapping the sheet of paper 6 therearound.

When the pin 23*e* comes into contact with the upper side of the arm 28*a* of the lever 28 in the forward rotations of the platen 4 during the wrapping or printing operation, the lever 28 turns in the counter-clockwise direction as viewed in the figures and gives way to the rotational movement of the pin 23*e* on the clamp member 23 around the axis of the platen 4, the pin 23*e* sliding on the upper side of the arm 28*a* of the lever 28, as described above; after the pin 23*e* slides over the the upper side of the arm 28*a* on such occasions, the lever 28 returns to the initial position shown in FIG. 3, being urged by the spring 26.

When the sheet of paper which has undergone printing is to be discharged, the platen 4 is again rotated in the reverse direction C to unwrap the sheet of paper; when the platen 4 is rotated to the position shown in FIG. 4, the sheet of printed paper is discharged.

While we have described and shown the particular embodiment of our invention, it will be understood that many modifications may be made without departing from the spirit thereof; we contemplate by the appended claims to cover any such modifications as fall within the true spirit and scope of our invention.

What is claimed is:

1. A paper supporting device of a printer, comprising:

a substantially cylindrical platen supported by a frame of the printer to be rotated around a central axis thereof in a forward and a reverse direction, said platen having a recess formed on a peripheral surface to extend in the axial direction thereof;

a clamp member mounted to said platen to be slidable in a radial direction of the platen, said clamp member having pressor portion extending in the axial direction of the platen to oppose a surface of said recess on the platen, and a projection extending from an axial end portion of the clamp member in the axial direction of the platen directed away from the platen, wherein said clamp member is constrained with regard to a movement in a circumferential direction with respect to the platen so that the clamp member is rotated together with the platen when the platen is rotated;

first urging means for urging said clamp member in a radial direction toward the axis of said platen;

a lever pivotably mounted to the frame of the printer at an axial position substantially in alignment with an axial position of said projection formed on an end portion of said clamp member, said lever having an arm which comes into contact with said projection on the clamp member when said clamp member is rotated with the platen;

stopper means for limiting a turning movement of said lever in a first pivoting direction at a predetermined angle at which said arm of the lever is slanted with respect to a circumferential direction of the platen such that an end of said arm is nearer to the axis of the platen than a pivoting portion thereof; and second urging means for urging said lever in said first direction toward said predetermined angle at which the lever is stopped by said stopper means;

said arm of the lever at said predetermined angle contacting said projection on the clamp member rotated in the forward direction of rotation with the platen to turn the lever in a second direction opposite to said first direction against the urging action of said second urging means by a rotational motion of said projection on the clamp member rotated with the platen, thereby allowing the platen to continue its forward rotation with the pressor portion of said clamp member pressed on the opposing surface of the recess on the platen, while, when said arm of the lever at said predetermined angle comes into contact with said projection on the clamp member rotated in the reverse direction of rotation with the platen, the projection on the clamp member being forced to slide along said arm of the lever stopped at said predetermined position by said stopper means so that the clamp member is slid with respect to the platen in the radial direction away from the axis of the platen against the urging action of said first urging means, thereby forming a gap between said pressor portion of the clamp member and the opposing surface of said recess on the platen.

2. A paper supporting device of a printer as claimed in claim 1, wherein said platen has end surface and said clamp member comprises a pair of leg portions extending from end portions of said pressor portion in said radial direction of the platen along the end surfaces of said platen, each of said leg portions being mounted to an end surface of said platen to be slidable in the radial direction.

3. A paper supporting device of a printer as claimed in claim 2, wherein said leg portions of the clamp member each have a groove extending in the radial direction of the platen, an axle of said platen slidably extending through said grooves in the leg portions of the clamp member.

4. A paper supporting device of a printer as claimed in claim 3, further comprising disk-shaped cam members fixedly secured to said platen between said end surfaces of the platen and the leg portions of said clamp member, said disk-shaped members each having a notch extending from a circumference thereof in the radial direction toward the center thereof, said leg portions of the clamp member each having a pin formed on a surface thereof to be sildably fitted into the notch of a disk-shaped member.

5. A paper supporting device of a printer as claimed in claim 3, wherein said first urging means comprises a helical spring having both ends secured to a leg portion of said clamp member, an axial central portion of the helical spring being wound around a portion of the axle of the platen to urge the clamp member with respect to the platen in the radial direction toward the axis of the platen.

* * * * *